US011230467B2

(12) United States Patent
Prochaska et al.

(10) Patent No.: US 11,230,467 B2
(45) Date of Patent: Jan. 25, 2022

(54) SYSTEMS AND METHODS FOR WIRELESSLY DETECTING A SOLD-OUT STATE FOR BEVERAGE DISPENSERS

(71) Applicant: Marmon Foodservice Technologies, Inc., Osseo, MN (US)

(72) Inventors: Daniel Prochaska, Elgin, IL (US); E. Scott Sevcik, Crystal Lake, IL (US); Michael Hanley, Willowbrook, IL (US); David K. Njaastad, Palatine, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 17/087,846

(22) Filed: Nov. 3, 2020

(65) Prior Publication Data

US 2021/0130149 A1 May 6, 2021

Related U.S. Application Data

(60) Provisional application No. 62/933,725, filed on Nov. 11, 2019, provisional application No. 62/930,296, filed on Nov. 4, 2019.

(51) Int. Cl.
*B67D 1/08* (2006.01)
*B67D 1/00* (2006.01)

(52) U.S. Cl.
CPC ..... *B67D 1/0871* (2013.01); *B67D 1/0085* (2013.01); *B67D 1/0888* (2013.01); *B67D 1/0021* (2013.01)

(58) Field of Classification Search
CPC ..... B67D 1/0871; B67D 1/0888; B67D 1/0085; B67D 1/0021; B67D 2210/00091; B67D 2201/0093; B67D 1/1277; B67D 1/1247
See application file for complete search history.

(56) References Cited

U.S. PATENT DOCUMENTS 6,299,020 B1 10/2001 Sudolcan et al.
6,382,464 B1 * 5/2002 Uzawa ..... B67D 1/0037 222/129.1

(Continued)

FOREIGN PATENT DOCUMENTS

DE 102012108583 B4 3/2014
DE 102015111385 A1 3/2016

(Continued)

OTHER PUBLICATIONS

Balakrishnan, Manu et al. Detection of Plunger Movement in DC Solenoids. Texas Instruments. Jun. 2015, pp. 1-10. Bangalore, Karnataka, India.
Chu, Jennifer MIT engineers configure RFID tags to work as sensors: Platform may enable continuous, low-cost, reliable devices that detect chemicals in the environment. MIT News Office. Jun. 14, 2018, pp. 1-6. Massachusetts.

(Continued)

*Primary Examiner* — Donnell A Long
(74) *Attorney, Agent, or Firm* — Andrus Intellectual Property Law, LLP

(57) ABSTRACT

A detection device for detecting that a source is sold-out for a beverage dispenser, the beverage dispenser dispensing from the source via a valve controlled by a solenoid. A circuit board is configured to be positioned on the valve proximal to the solenoid. A detector is coupled to the circuit board, where the solenoid creates a magnetic field when dispensing from the valve, and where the detector detects the magnetic field created by the solenoid and consequently produces an electrical output. A control system is coupled to the circuit board in communication with the detector. The control system is configured to access threshold data and to compare the electrical output of the detector to the threshold data. The control system indicates that the source is sold-out (Continued)

based upon the comparison of the electrical output to the threshold data.

20 Claims, 10 Drawing Sheets

(56) References Cited

U.S. PATENT DOCUMENTS

| | | | | |
|---|---|---|---|---|
| 6,402,478 | B1 | 6/2002 | Zhang et al. | |
| 6,685,054 | B2 | 2/2004 | Kameyama | |
| 6,761,284 | B2 | 7/2004 | Knelper | |
| 6,809,515 | B1 | 10/2004 | Li et al. | |
| 6,809,516 | B1 | 10/2004 | Li et al. | |
| 6,942,469 | B2 | 9/2005 | Seale et al. | |
| 7,990,663 | B2 | 8/2011 | Ziegler et al. | |
| 8,763,655 | B2 | 7/2014 | Springer | |
| 9,284,174 | B2 | 3/2016 | Springer | |
| 9,991,038 | B2 | 6/2018 | Kim | |
| 10,207,910 | B2 | 2/2019 | Springer | |
| 10,295,077 | B2 | 5/2019 | Haller | |
| 10,562,757 | B2 | 2/2020 | Biasi et al. | |
| 2008/0073376 | A1* | 3/2008 | Gist | A23G 9/28 222/145.5 |
| 2016/0290368 | A1 | 10/2016 | Collins | |
| 2019/0375623 | A1 | 12/2019 | Beavis et al. | |
| 2020/0180941 | A1 | 6/2020 | Biasi et al. | |

FOREIGN PATENT DOCUMENTS

| | | | |
|---|---|---|---|
| GB | 2354557 | A | 3/2001 |
| JP | 5630354 | B2 | 11/2014 |
| KR | 101523356 | B1 | 5/2015 |
| WO | 2020094885 | A1 | 5/2020 |

OTHER PUBLICATIONS

Khan, Farid Ullah. Energy Harvesting from the Stray Electromagnetic Field around the Electrical Power Cable for Smart Grid Applications. Hindawi Publishing Corporation, The Scientific World Journal. Jun. 14, 2016. vol. 2016, Article ID 3934209, 20 pages. Peshawar, Pakistan.

Penn State. Scientists tap unused energy source to power smart sensor networks. Science Daily. Apr. 1, 2020.

Sample, Alanson P. et al. Design of a Passively-Powered, Programmable Sensing Platform for UHF RFID Systems. Intel Research. Jan. 24, 2007.

Sensor RFID Tags. AtlasRFIDstore. Accessed on Aug. 31, 2020 at https://www.atlasrfidstore.com/sensor-rfid-tags/.

* cited by examiner

DC SOLENOID VALVE CURRENT WITH $N_2$ APPLIED - 10ms TO OPEN

SYSTEMS AND METHODS FOR WIRELESSLY DETECTING A SOLD-OUT STATE FOR BEVERAGE DISPENSERS

CROSS REFERENCE TO RELATED APPLICATIONS

This application claims the benefit of U.S. Provisional Patent Application Nos. 62/930,296 and 62/933,725, filed Nov. 4, 2019 and Nov. 11, 2019, respectively, which are incorporated herein by reference in their entireties.

FIELD

The present disclosure generally relates to systems and methods for detecting a sold-out state for beverage dispensers, and more particularly to systems and methods for wirelessly detecting a sold-out state for beverage dispensers by monitoring the current of an electronic valve.

BACKGROUND

The following U.S. Patents and Patent Publications provide background information and are incorporated by reference in entirety.

U.S. Pat. No. 8,960,016 discloses a method for determining the flow rates of a fluid comprising a multi-component mixture of a gas and at least one liquid in a pipe, the method comprising the following steps: a. the permittivity of the multi-component mixture is determined based on an electromagnetic measurement, b. a statistical parameter related to the electromagnetic measurement is calculated, c. the density of the multi-component is determined, d. the temperature and pressure are obtained, e. based on the knowledge of densities and dielectric constants of the components of the fluid mixture, and the result from the above steps a-c, the water fraction of the multi-component mixture is calculated, characterized by a method for determining the liquid fraction and flow rates of the multi-component mixture where f. the liquid fraction is calculated based on the statistical parameter from step b and the calculated water fraction from step e using an empirical derived curve, g. the velocity of the multi-component mixture is derived, and h. based on the step a-g, the flow rate of the individual components of the multi-component mixture is calculated. An apparatus for performing the method is also disclosed.

U.S. Pat. No. 4,236,553 discloses an electronic controller for solenoid valve actuated beverage dispensers which allows the operator to automatically dispense properly filled cups of various sizes. A slideably mounted electronic probe is lifted by the lip of the cup positioned under the dispenser spout. Actuation of a switch energizes the solenoid valves starting the dispensing cycle. When the cup is filled to the level of the probe, the solenoid valves are de-energized. Early de-energization of the solenoid valves by bubbles is avoided by adjusting a time delay-off knob so that the proper level will be attained for each class of beverage. Too much or too little ice in the glass will not affect the level. Digital counters record the number of drinks served by size or price.

U.S. Pat. No. 6,058,986 discloses an electronic control for an automatic filling beverage dispensing valve. The dispensing valve includes a valve body, a flow control mechanism and a solenoid. The valve further includes an electrically conductive cup actuated lever for operating a micro-switch that is operatively connected to the electronic control of the present invention. The valve body includes a nozzle and a stainless steel electrical contact for providing electrical connection between the electronic control and the beverage as it flows through the nozzle into a cup. The electronic control of the present invention is microprocessor controlled and includes an internal signal generator which generates a signal independent of the input line frequency supplying the power to the control. This generated signal is buffered and applied to the dispensing cup lever while simultaneously being applied to a reference input of a phase-locked loop detector circuit. When beverage fills a cup to the rim thereof the beverage can flow over the rim and thereby provide an electrical continuity between the electrically conductive lever and the stainless steel contact within the nozzle. Thus, a signal is conducted to an input of the phase locked-loop detector circuit where that electrical signal is compared to the generated reference signal. If the two signals are matched in both frequency and phase, the detector circuit generates a continuity detected signal to the micro-processor. The microprocessor thereby ends dispensing by de-energizing the solenoid.

U.S. Patent Application Publication No. 2019/0194010 discloses a beverage dispensing machine that includes a valve body configured to receive a first fluid and a second fluid and dispense the first fluid through a first orifice and the second fluid through a second orifice. A first valve seal is movable to open and close the first orifice, and a second valve seal is movable to open and close the second orifice. An arm is pivotally coupled to the valve body, and pivoting of the arm relative to the valve body moves the first valve seal and the second valve seal and thereby opens the first orifice and the second orifice. The machine also includes a solenoid valve configured to pivot the arm, and a handle with a leg that is pivotable into and between a rest position in which the valve seals are closed and an active position in which the valve seals are open. As the handle moves from the rest position to the active position, the leg acts on the solenoid valve such that the arm pivots and the valve seals open.

U.S. Pat. Nos. 4,728,005, 4,944,332, 5,537,838, and 6,170,707 also provide general information relating to the current state of the art and are incorporated by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a detection device for detecting that a source is sold-out for a beverage dispenser, the beverage dispenser dispensing from the source via a valve controlled by a solenoid. A circuit board is configured to be positioned on the valve proximal to the solenoid. A detector is coupled to the circuit board, where the solenoid creates a magnetic field when dispensing from the valve, and where the detector detects the magnetic field created by the solenoid and consequently produces an electrical output. A control system is coupled to the circuit board in communication with the detector. The control system is configured to access threshold data and to compare the electrical output of the detector to the threshold data. The control system indicates that the source is sold-out based upon the comparison of the electrical output to the threshold data.

Another embodiment generally relates to a method for detecting that a source is sold-out for a beverage dispenser, the beverage dispenser dispensing from the source via a valve controlled by a solenoid. The method includes coupling a detector to a circuit board, where the solenoid creates a magnetic field when dispensing from the valve, and where the detector is configured to detect the magnetic field created by the solenoid and to produce an electrical output when the magnetic field is detected. The method further includes providing threshold data accessible relating to the electrical output of the detector when detecting the magnetic field from the solenoid. The method further includes coupling the control system to the circuit board in communication with the detector, where the control system is configured to access the threshold data, and where the control system is configured to compare the electrical output of the detector to the threshold data. The method further includes positioning the circuit board on the valve proximal to the solenoid, where the control system indicates whether the source is sold-out based upon the comparison of the electrical output to the threshold data.

Another embodiment generally relates to a detection device for detecting that a source is sold-out for a beverage dispenser, the beverage dispenser dispensing from the source via a valve controlled by a solenoid that axially translates an armature through a top of a frame containing the solenoid. A circuit board is configured to be positioned on top of the valve proximal to the solenoid, where the circuit board is electrically and fluidly isolated from the solenoid, and where an opening is defined in the circuit board such that the armature extends therethrough. A detector is coupled to the circuit board, where the solenoid creates a magnetic field when dispensing from the valve, and where the detector is configured to detect the magnetic field created by the solenoid and to produce an electrical output when the magnetic field is detected. A control system is coupled to the circuit board in communication with the detector, where the control system is configured to access threshold data. The threshold data includes both a magnitude threshold and a time threshold. The magnitude threshold includes a lower magnitude threshold and an upper magnitude threshold, where a first time crossing occurs when the electrical output of the detector first exceeds the lower magnitude threshold, where a second time crossing occurs when the electrical output of the detector first decreases below the upper magnitude threshold after the first time crossing, and where the time threshold corresponds to an elapsed time between the second time crossing and the first time crossing. The control system is configured to compare the electrical output of the detector to the threshold data, and to indicate that the source is sold-out based upon the comparison of the electrical output to the threshold data.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

To maintain high quality beverages meeting customer demands for beverage dispensers presently known in the art, it is important for owners to quickly identify when one or more sources of content are sold-out. Sources may include a syrup concentrate and/or a base liquid (such as gasified water) in the context of a soda dispensing machine, for example. One way in which owners currently receive notification that one or more sources have been sold-out is by direct feedback from a consumer. For example, a beverage dispensed from the beverage dispenser may lack the expected color, and/or not have the expected taste or gasification level. The owner would prefer to know of a source being sold-out before this point to avoid customer dissatisfaction.

A more automated notification system is also known in the art. This automated system uses pneumatic switches connected in-line with valves within the beverage dispenser to detect a loss of pressure in tubing that communicates content from the source, such as a bag or bottle, to the dispensing valve when the source is sold-out. However, the present inventors have identified that these pneumatic switches typically cost several dollars each. In the context of a beverage dispenser having multiple sources (e.g. different flavors of sodas, different additives, sweetening options, caffeination options, and/or the like), this system become expensive to outfit. This is true both from a piece part cost standpoint, and for installation and service times.

Pneumatic switches presently known in the art are also physically large, often approximately 2.5×2×0.5 inches uninstalled, which requires adequate clearance within the beverage dispenser to install and house them. Since each of these pneumatic switches must also be connected in line with the tubing between the source and each valve, fittings are also required. This adds further cost and installation time, exacerbates the problem of bulkiness, and also introduces additional risk for leaks and failure.

Furthermore, the nature of these pneumatic switches and the operating mechanisms therein, which include mechanical contacts and springs, provides that there is an inherently limited lifespan before the device will fail. Likewise, these devices are prone to accuracy issues due to sensitive reactions to tolerance limits. This results in inaccurate determinations of sold-out states, and/or drifting performance levels over time.

In contrast, the systems and methods presently disclosed provide for a low cost, no-contact alternative for detecting a sold-out state for one or more sources of content within a beverage dispensing machine. Moreover, the present solutions are applicable both new systems, and as a retrofittable add-on for existing systems.

Figure 1:
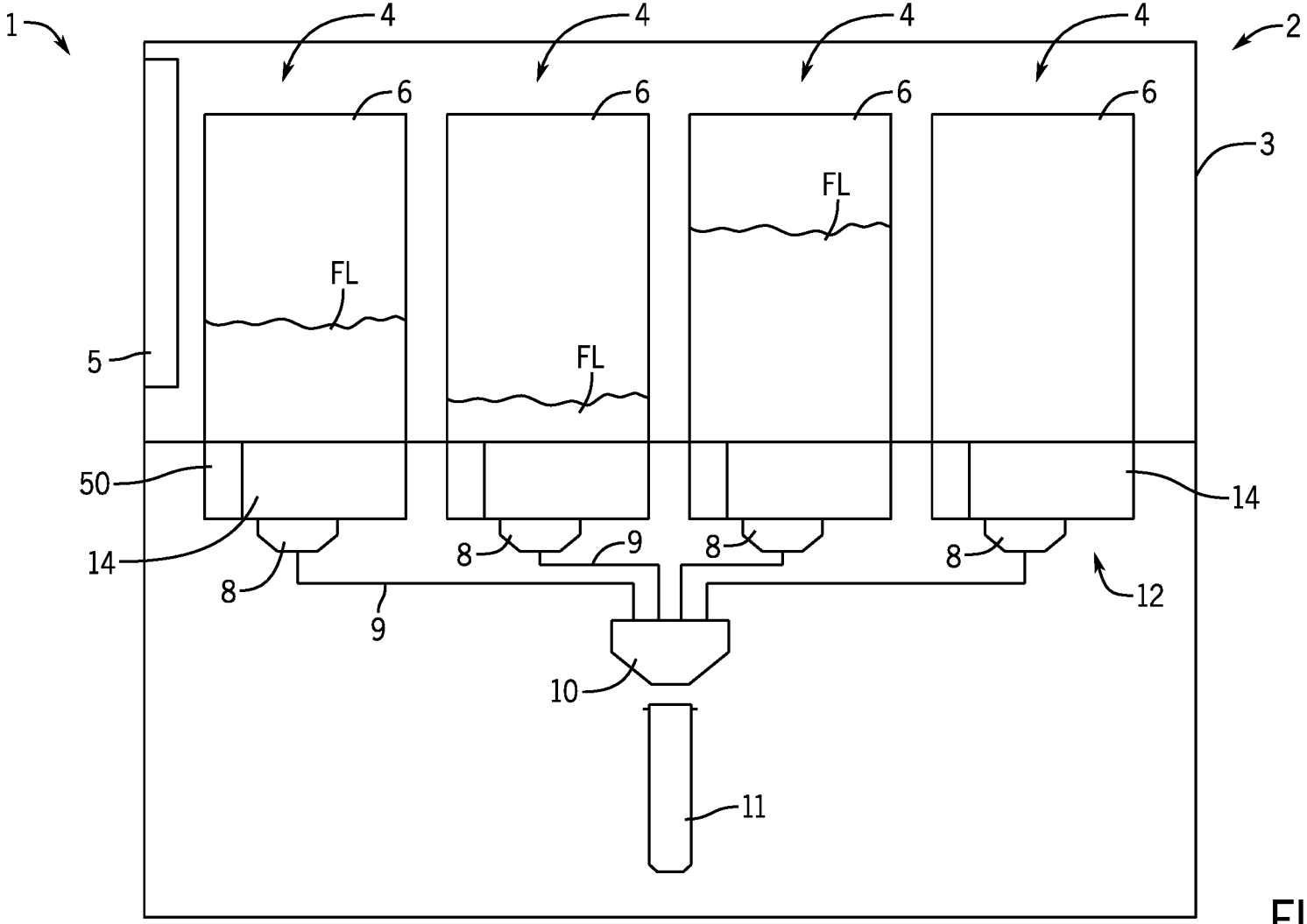
FIG. 1 is a front view of an exemplary beverage dispenser incorporating a system according to the present disclosure.

FIG. 1 depicts an exemplary system 1 according to the present disclosure incorporated within a beverage dispenser 2. The beverage dispenser 2 includes a cabinet 3 defining multiple locations 4 for receiving various sources 6 containing the content to be dispensed. A main controller 5 provides control of the beverage dispenser 2 in the manner known in the art, but may be further modified to detect the sold-out state of a source 6 as disclosed herein. The controller 5 may be structured like the control system 200 of FIG. 6 as discussed below, for example. In certain embodiments, a source 6 may be dispensed directly, such as in the context of a freshly brewed tea or coffee beverage, milk, or pre-mixed beverages. In other examples, which may be provided within the same cabinet 3, the content of one or more sources 6 are mixed with each other, (e.g. multiple flavors and/or with a gasified water line) to together form the beverage being dispensed. For the sake of brevity, all constituent components will generally be referred to as a source 6, whether served alone or in combination, including gasified water lines, for example.

FIG. 1 further depicts three of the sources 6 having a fill level FL of content therein, with a fourth source 6 being sold-out. It should be recognized that the fill level FL need not be literal, such as in the context of a liquid, but may be a representation of a remaining gas within a tank, for example. One such example is a source 6 containing nitrogen ($N_2$) configured to be mixed with other constituent parts for dispensing a nitrogen-infused beverage.

Each of the sources 6 is fluidly coupled to dispensing hardware 12, which selectively communicates the content for the respective source 6 out via an output nozzle 8. In the embodiment shown, the output nozzle 8 does not directly dispense the beverage into a cup, for example, but is instead fed via lines 9 to a main spout 10. This configuration provides for dispensing beverages in which the content of multiple sources 6 is mixed prior to being dispensed from a single main spout 10. However, it should be recognized that in other examples, the output nozzle 8 for one or more locations 4 may also be its own main spout 10 whereby a combination of sources 6 is not required. In the embodiment of FIG. 1, the beverage dispenser 2 is further provided with a fill actuator 11, such as a lever, which allows a user to press a cup or other container against the fill actuator 11 to request the dispensing of a beverage.

Figure 2B:
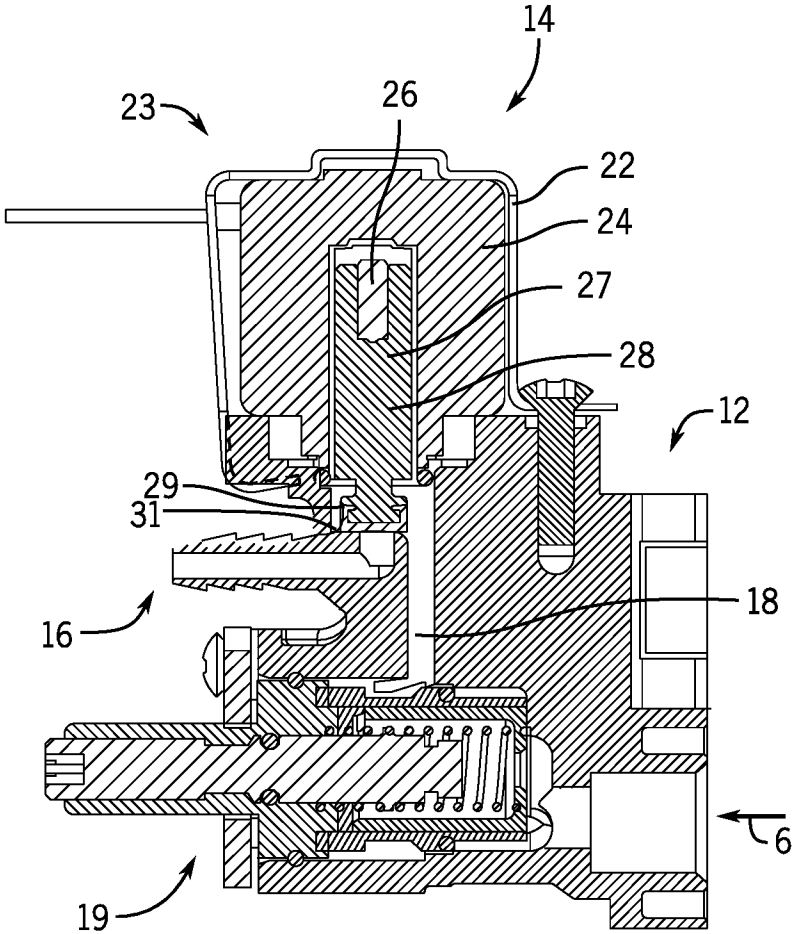
FIGS. 2A-2B depict a cross sectional view of a valve presently known in the art shown in open and closed positions, respectively.
Figure 2A:
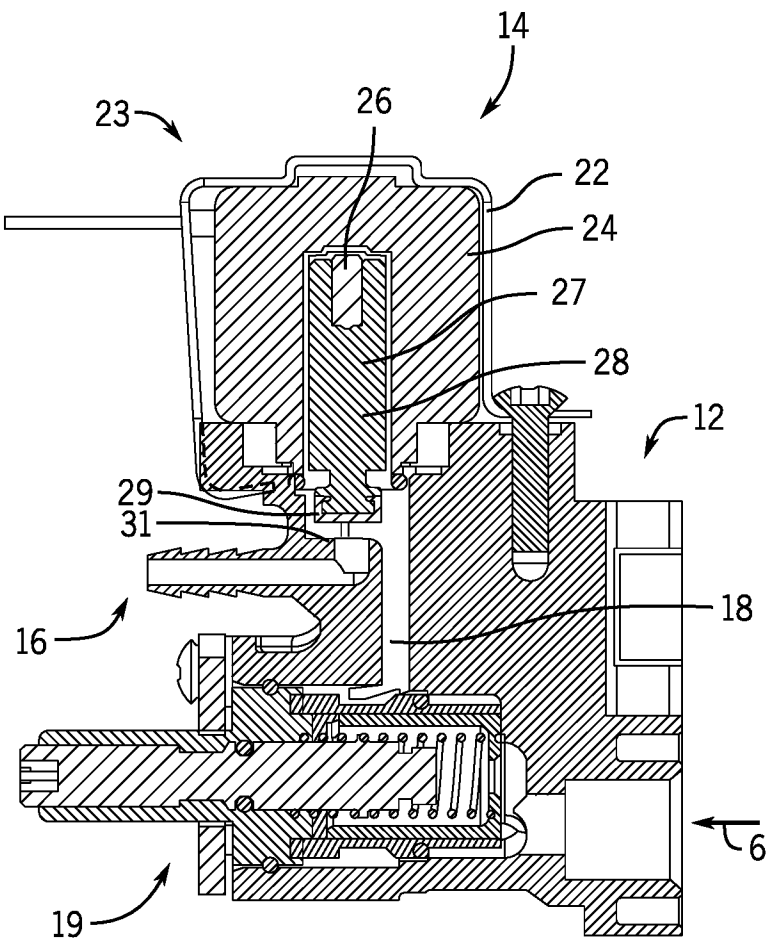

As shown in FIGS. 2A-2B, the dispensing hardware 12 may include an electronically actuated valve 14, such as that disclosed in U.S. Patent Application Publication No. 2019/0194010, which in the present case is a solenoid 20 having a frame 22 enclosing a coil 24 in a manner known in the art. In general, the electrically actuated valve 14 operates by selectively providing voltage to a solenoid coil 24, which creates a magnetic field that acts upon an armature 27 received within the coil 24 via the top 23 of the frame 22. Specifically, this magnetic field causes the armature 27 to move axially within the solenoid 20. It will be recognized that the magnetic field may also be referred to as an electromagnetic field, or EMF.

The armature 27 is also a plunger 28, or is coupled to a plunger 28, with the plunger 28 having a seal 29. Axial translation of the plunger 28 selectively seats this seal 29 against a floor 31 to allow or restrict flow between an inlet 18 and an outlet 16 within the electronically actuated valve 14 in a customary manner. In the example shown in FIGS. 2A-2B, the armature 27 and plunger 28 are biased via a spring 26 to position the electronically actuated valve 14 downwardly in the closed position, which in this configuration opposes a fluid pressure provided by the fluid at the inlet 18 on the plunger 28. The pressure provided by the fluid at the inlet 18 may be controlled via a pressure regulator 19, for example. Therefore, the electronically actuated valve 14 is therefore movable between the open and closed positions shown in FIGS. 2A-2B, respectively, via control of the solenoid 20 in a customary manner. Exemplary electrically actuated valves 14 include the UFI, UFB, or multi-flavor/MFV valve made by Cornelius, Inc.

Figure 3A:
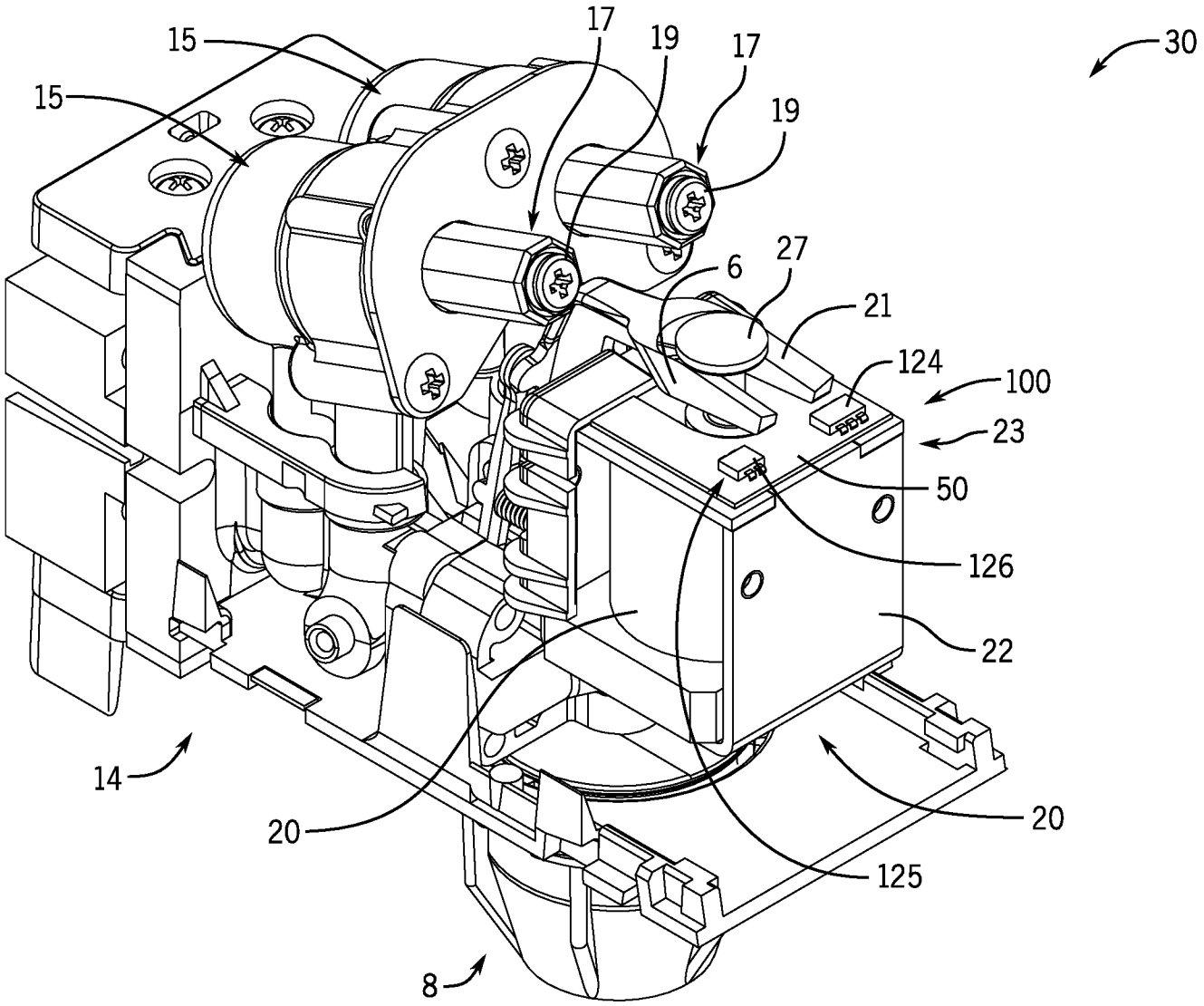
FIGS. 3A-3B are left and right isometric views, respectively, of two embodiments of exemplary systems according to the present disclosure.
Figure 3B:
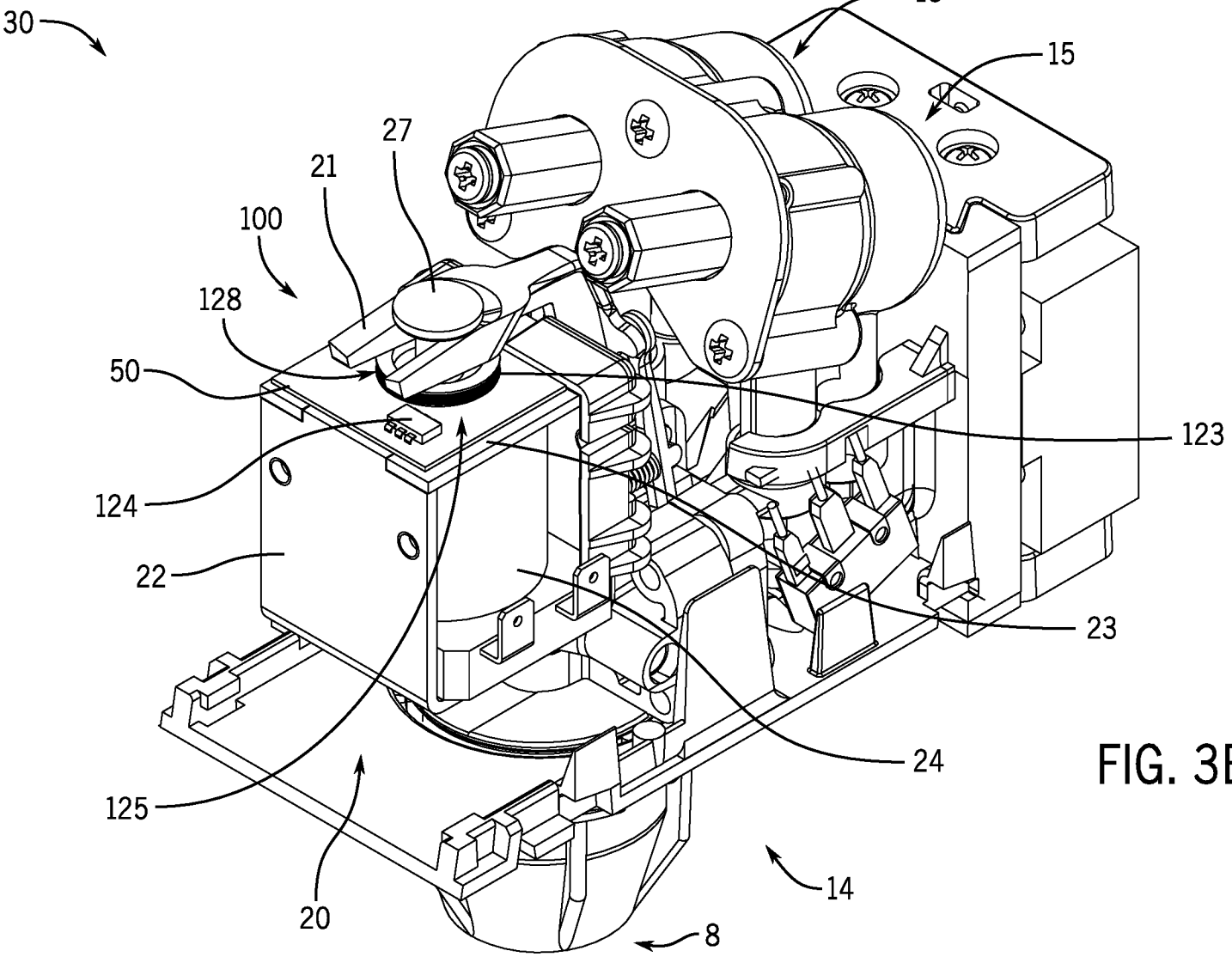

Another exemplary electrically actuated valves 14 is further shown in FIGS. 3A-3B, whereby the armature 27 is separate from the plunger (not shown), but moves the plunger via an actuation fork 21 moveably coupling the two in a manner known in the art. In the embodiment shown, the electrically actuated valves 14 use a single solenoid 20 to simultaneously control the flow from two sources (the two separate plungers and pathways shown as two separate subsystems 15) to be dispensed together, such as syrup and carbonated water, for example. The pressure from each of the subsystems 15 may be adjusted via pressure regulators 17 in a manner known in the art.

However, unlike systems presently known in the art, which provide no mechanism for determining sold-out state without the incorporation of a physically wired system voltage detection previously discussed, the embodiments of FIGS. 3A-3B include the addition of a detection system 100 according to the present disclosure, together constituting a combined system 30, which is discussed further below. It will be recognized that while the present disclosure principally discusses a single detection system 100, multiple detection systems 100 may be deployed within the same beverage dispenser 2, for example having a separate detection system for each source 6, or for each electrically actuated valve 14 (which also may combine flows from multiple sources 6, for example).

Through experimentation and development, the present inventors have identified that the state of a given source 6, and specifically whether or not it is sold-out, can be detected by monitoring the current flowing through the electronically actuated valve 14 over time. In particular, the time for the electronically actuated valve 14 to transition from a closed state to an open state, upon being requested to do so to dispense a beverage, varies depending upon this sold-out state of the source 6 fluidly connected at the inlet 18. This current may be monitored by a current sensor providing data to a control system 200, which may be integrated into the main controller 5 or a separate ancillary circuit board 50 (FIG. 1), particularly for retrofitting an existing beverage dispenser 2. The current sensor and/or ancillary circuit board 50 may also be directly incorporated within the dispensing hardware 12, as discussed further below.

Figure 4A:
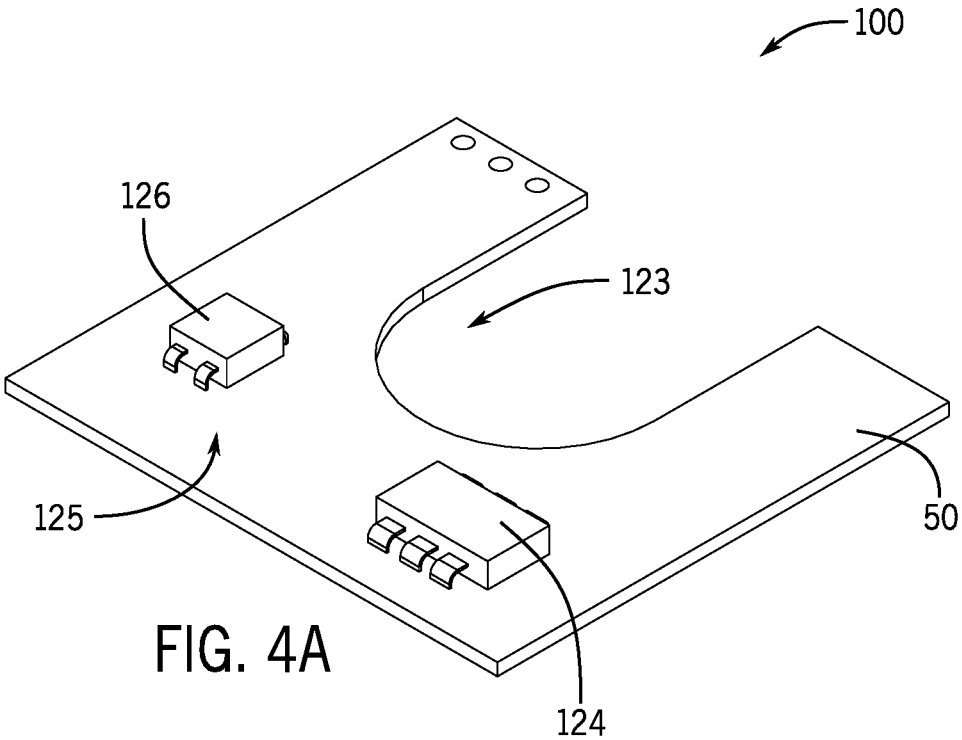
FIGS. 4A-4B are isometric views of two exemplary detection systems according to the present disclosure, removed from the systems shown in FIGS. 3A-4B, respectively.
Figure 4B:
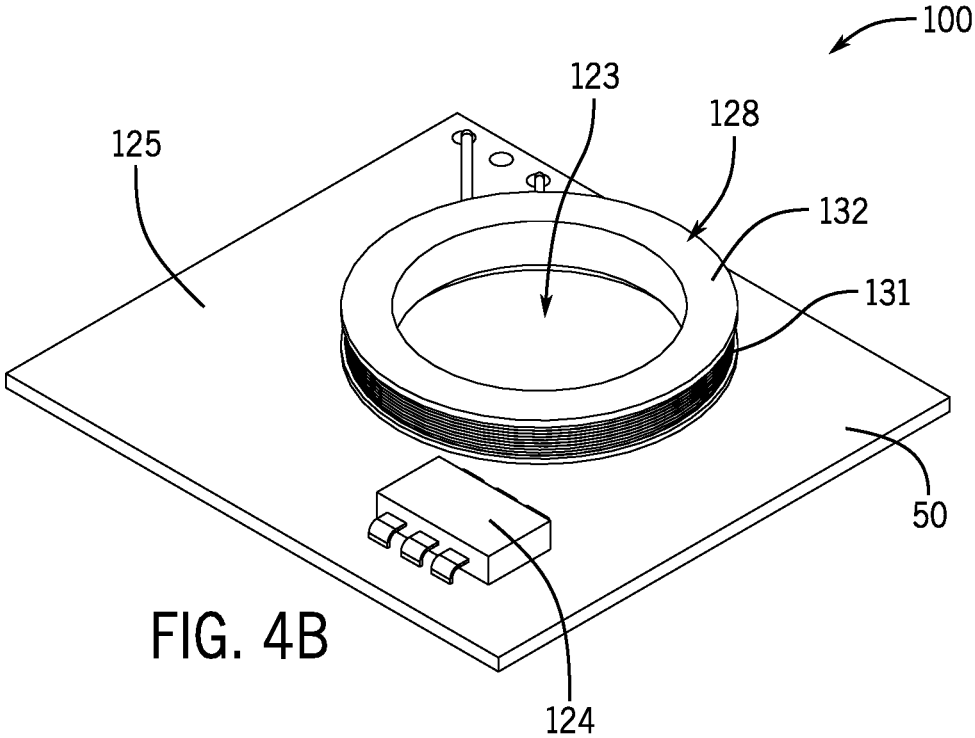
Figure 5A:
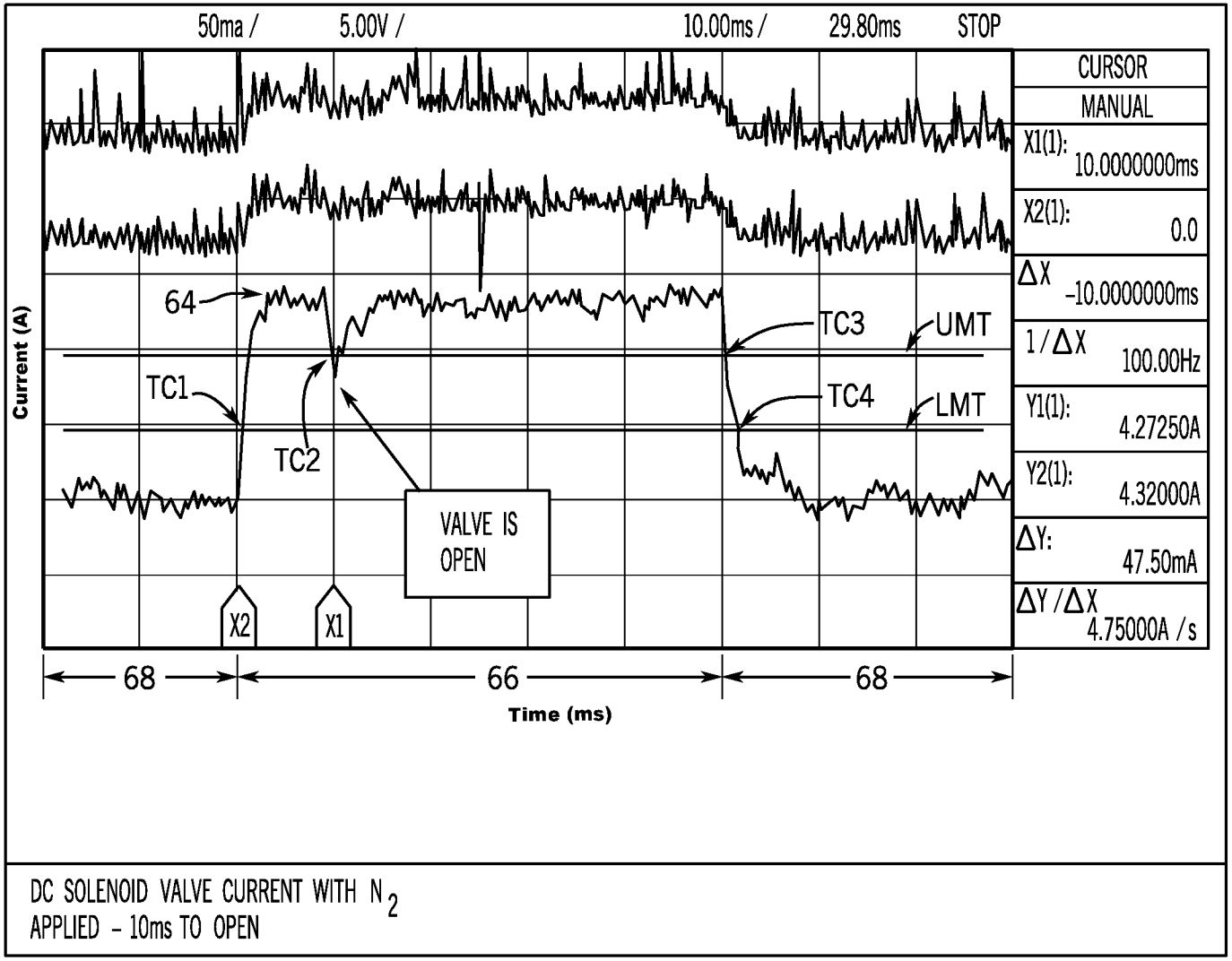
FIGS. 5A-5B depict exemplary waveforms obtained and used an exemplary detection system according to the present disclosure.
Figure 5B:
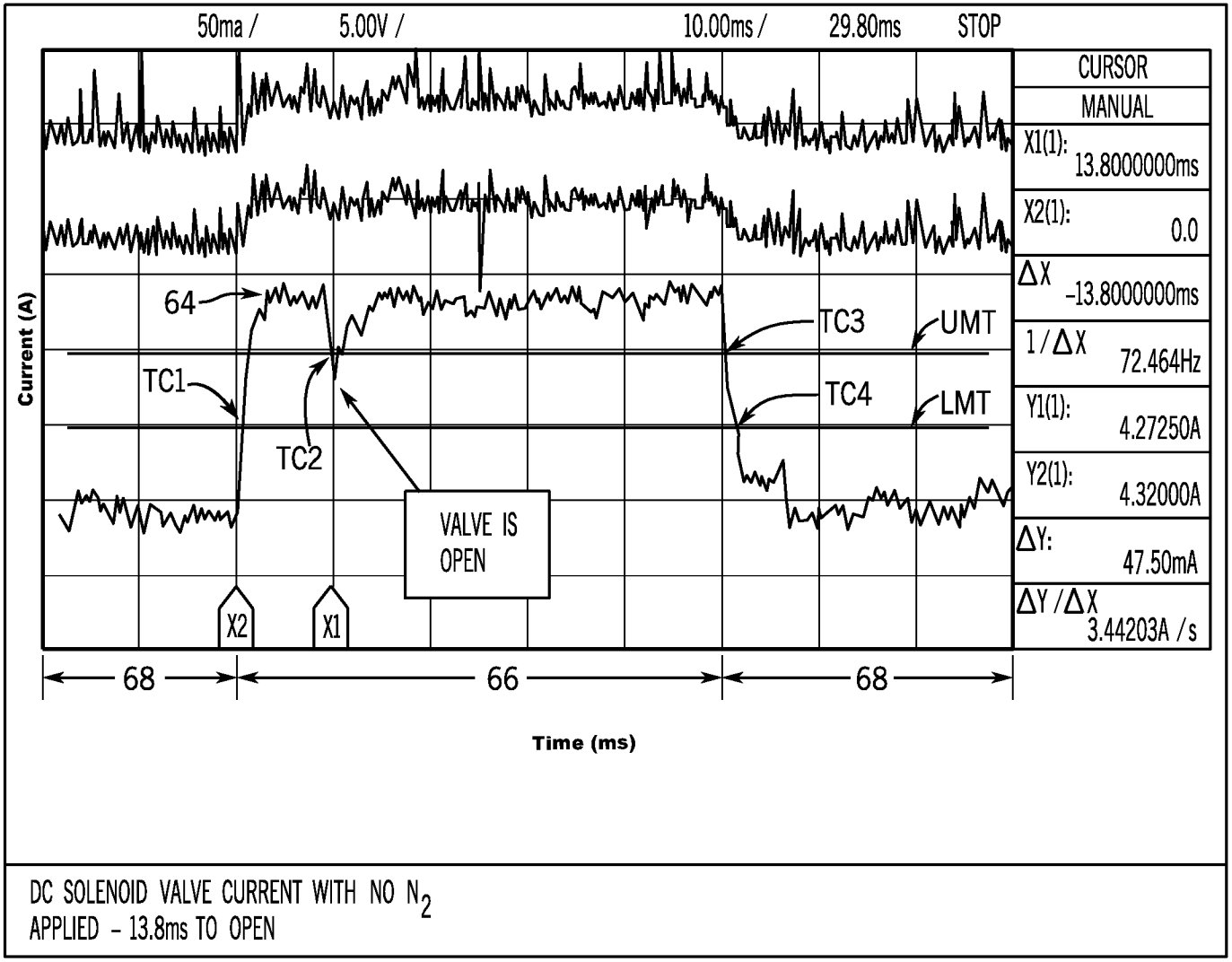

FIGS. 5A and 5B depict two exemplary detection systems 100 for detecting and monitoring the current produced by the solenoid 20 of the electrically actuated valve 14, which have been removed from the combined systems 30 shown in FIGS. 4A and 4B, respectively. As will become apparent, these detection systems 100 may be incorporated within newly produced valve systems, or retrofitted for electrically actuated valves 14 presently in service. In each embodiment, the detection system 100 includes an ancillary circuit board 50, such as a circuit board, which is configured to be positioned in close proximity to the solenoid 20. In the embodiments shown, the ancillary circuit board 50 is particularly positioned on the top 23 of the frame 22 for the solenoid 20. The inventors have identified that this location for mounting the ancillary circuit board 50 would be particularly convenient in the case of retrofitting an existing electrically actuated valve 14, for example.

Each exemplary ancillary circuit board 50 defines an opening 123 that allows the armature 27 to remain axially movable within the solenoid coil 24 without obstruction. Each system 100 further includes a detector 125 that produces an electrical output responsible to magnetic fields. In the embodiment of FIG. 4A, this detector 125 is a current sensor or Hall Effect sensor 126, whereas in FIG. 4B the embodiment depicts a coil 128 (e.g. such as many be used in an anti-theft device in a retail store) as the detector 125. However, it should be recognized that any device that produces an electrical output response of two magnetic fields may function as the detector 125.

The detector 125 is particularly coupled to the ancillary circuit board 50 such that the magnetic field created by the solenoid 20 when in operation is detectable by the detector 125. With respect to the embodiment shown in FIG. 4A, the inventors have identified that positioning the Hall Effect sensor 126 to be aligned with the coil 24 on the solenoid 20, and in the present case directly above it, is particularly advantageous in that the magnetic field is strong in this region. With respect to the embodiment of FIG. 4B, the coil 128 is positioned to be coaxially aligned with the coil 24 of the solenoid 20. Additional advantages to positioning the coil 128 type of detector 125 to be coaxially aligned with the coil 24, or centered about the armature 27, are discussed below.

In each detection system 100 shown, the detector 125 is further operatively coupled to a control system 124 that detects the electrical output produced by the detector 125 responsive to the magnetic field. The control system 124 may be structure like the control system 200 of FIG. 6 as discussed below, for example.

As is discussed further below, the control system 124 is configured to analyze the electrical output produced by the detector 125 relative to threshold data 72 stored in memory, which includes threshold times for comparing to the elapsed time of the timer 74, to determine the sold-out state of a source 6, the operational condition of the electrically actuated valve, and other conditional aspects of the beverage dispenser 2. It will be recognized that the threshold times corresponding to a sold-out state (versus a non sold-out state) vary based upon the solenoid, valve, and particular beverage being dispensed, for example. Other factors may also be relevant, including an ambient temperature, the incoming pressure of the beverage, and the like. In certain examples, the threshold time of the configuration is 12 ms, whereby elapsed times for opening the valve in excess of this threshold time correspond to a sold-out state (i.e., the beverage is no longer assisting in the opening process), for example. This analysis may then be communicated with other devices, such as to send notice to an operator of a sold-out state, for example.

Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

Figure 6:
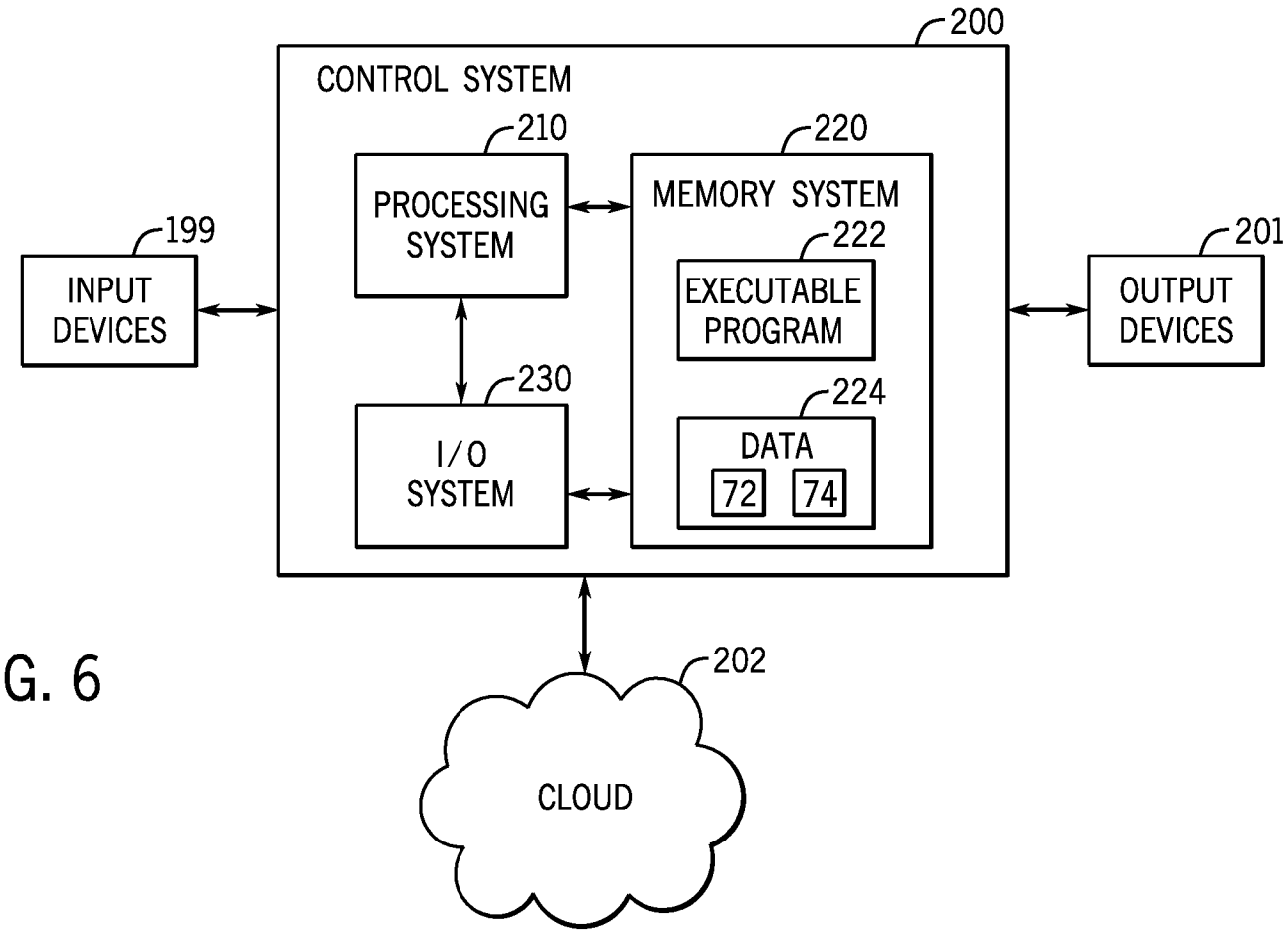
FIG. 6 is a schematic view depicting an exemplary control system for operating the systems and methods presently disclosed.

FIG. 6 depicts an exemplary control system 200 that may be provided as the controller 5 in the beverage dispenser 2 (FIG. 1), and/or as the control system 124 of one or more detection systems 100. The control system 200 may be a computing system that includes a processing system 210, memory system 220, and input/output (I/O) system 230 for communicating with other devices, such as input devices 199 (e.g., the detector 125) and output devices 201 (e.g., the electronically actuated valve 14, notification devices, and/or a cloud 202). The processing system 210 loads and executes an executable program 222 from the memory system 220, accesses data 224 stored within the memory system 220, and directs the system 1 to operate as described in further detail below.

The processing system 210 may be implemented as a single microprocessor or other circuitry, or be distributed across multiple processing devices or sub-systems that cooperate to execute the executable program 222 from the memory system 220. Non-limiting examples of the processing system include general purpose central processing units, application specific processors, and logic devices.

The memory system 220 may comprise any storage media readable by the processing system 210 and capable of storing the executable program 222 and/or data 224 (such as threshold data 72 and time thresholds TT). The memory system 220 may be implemented as a single storage device, or be distributed across multiple storage devices or sub-systems that cooperate to store computer readable instructions, data structures, program modules, or other data. The memory system 220 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

The present inventors has identified that high speed data collection electronics (such as within the control system 200 discussed above) are not currently used in the beverage industry, and particularly to ascertain when a source 6 is sold-out or not going to meet specification.

As is discussed further below, the presently claimed system 1 provides that when dispensing hardware 12 is turned on to dispense product, the current through the dispensing hardware 12 is monitored. This current begins to increase as a magnetic field builds up, before the electronically actuated valve 14 has opened. At a point later in time, (e.g., once the armature 27 of the solenoid 20 within the electronically actuated valve 14 begins to move, the inventors have recognized that a back EMF is then generated, which modifies the shape of the current.

Through experimentation and development, the inventors have identified that these changes in current can be detected, and that the shape of the current waveform further changes depending on whether or not the source 6 is sold-out. Specifically, the presence of content within a source 6 creates a force against the valve that either aids or opposes the opening operation, thereby impacting the speed of such action. The speed of opening the electronically actuated valve 14 also depends upon the valve's construction, the content, and the path the content travels in flowing therethrough. In certain embodiments, electronically actuated valves 14 are characterized by taking samples of the current with no media present, which is then used as a reference for each successive operation of the electronically actuated valves 14. It will be recognized that other electrical characteristics of the valve's operation may be monitored in addition to or as alternatives to current, including voltage and/or power of the valve, for example. In a similar manner, an integral of the area under the electrical waveforms discussed further below (e.g., FIGS. 5A-5B) may also or alternatively be monitored and compared to a threshold value demarcating a sold-out state versus a non sold-out state, for example.

The same principles apply when the valve is later closed. Depending on the electronically actuated valves 14 topology, the state of the source 6 either aids or inhibits the closing process, thereby impacting the time for such closing.

FIGS. 5A-5B depict exemplary waveforms of current data captured while monitoring the current for an electronically actuated valve 14 coupled to a source in a regular (not sold-out) state and a sold-out state, respectively. In each case, an energized phase 66 is shown interposed between two de-energized phases 68, whereby the energized phase 66 corresponds to when power is commanded to the electronically actuated valve 14. As shown, a lower magnitude threshold LMT and an upper magnitude threshold UMT (also referred to as magnitude values) are provided as threshold data 72, which in certain embodiments is determined based on a given electronically actuated valve 14 and source 6. The threshold data 72 may determined empirically and saved in a lookup table for that electronically actuated valve 14 and/or type thereof, for example.

In the waveforms shown, the current 64 crosses the lower magnitude threshold LMT and upper magnitude threshold UMT at threshold crossings TC1-TC4. When an electronically actuated valve 14 is initially powered on, indicating a transition from the de-energized phase 68 to the energized phase 66, the current 64 first exceeds the lower magnitude threshold LMT (at the first threshold crossing TC1), then also the upper magnitude threshold UMT. The control system 200 begins counting an elapsed time since the current 64 first crossed over the lower magnitude threshold LMT at the first threshold crossing TC1. As can be seen in FIGS. 3A and 3B, the current 64 then dips below the upper magnitude threshold UMT momentarily (here the downward crossing being marked as the second threshold crossing TC2), which the inventors identified to occur at the instant in which the electronically actuated valve 14 physically opens such that flow is unrestricted between the inlet 18 and the outlet 16. The current 64 once again rises above the upper magnitude threshold UMT until the time at which power is removed from the electronically actuated valve 14 and the energized phase 66 transitions to the de-energized phase 68. The time which the current 64 falls below the upper magnitude threshold UMT is marked as the third threshold crossing TC3, and the time at which the current 64 falls below the lower magnitude threshold LMT marked as the fourth threshold crossing TC4.

The inventors noted that the elapsed time between threshold crossings TC1 and TC2, or between the current 64 first exceeding the lower magnitude threshold LMT (at first time threshold crossing TC1, the start of the energized phase 66) and the temporary dip between the upper magnitude threshold UMT and lower magnitude threshold LMT occurring coincident with the electronically actuated valve 14 opening (second threshold crossing TC2), varies depending on whether the source 6 supplying the fluid at the inlet 18 is sold-out. Since the pressure provided by the content of the source 6 in the configuration shown in FIGS. 2A and 2B assists in the opening of the plunger 28 when not sold-out, it follows that the elapsed time for the electronically actuated valve 14 to open is less when that source 6 is not sold-out. This non-sold-out state is exemplified in FIG. 3A, in contrast to when the source 6 is sold-out as exemplified in FIG. 3B. However, it should be recognized that the opposite would be true in a situation in which the content from the source 6 is not assistive in the process of opening the plunger 28.

One or more time thresholds are then provided within the threshold data 72, whereby an elapsed time for opening that is below the threshold corresponds to a non-sold-out state, whereas an elapsed time at or above the threshold corresponds to a sold-out state for the source 6, for example. In the case in which a single electrically actuated valve 14 is fed by two or more sources 6, multiple time thresholds may exist corresponding to one or multiple of the sources being sold-out, for example.

Figure 7:
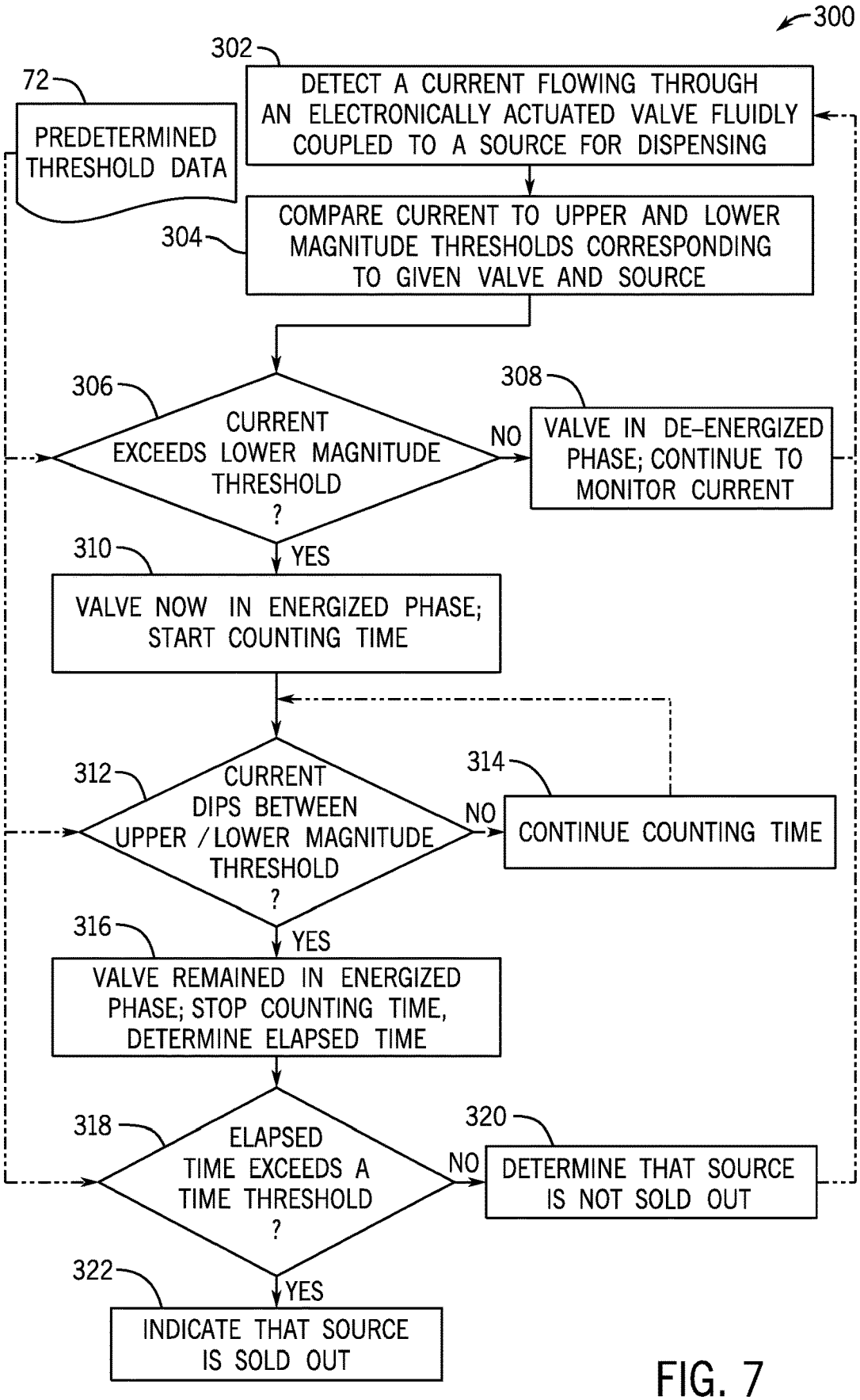
FIG. 7 depicts an exemplary process flow for detecting a sold-out state for a beverage dispenser according to the present disclosure.

FIG. 7 depicts an exemplary process flow 300 for detecting a sold-out state of a source 6 according to the present disclosure, for example by the control system 200. Step 302 includes detecting a current 64 flowing through an electronically actuated valve 14 that is fluidly coupled to a source 6 for dispensing. The current 64 detected in step 302 is compared, for example with a control system 124 within the detection system 100, for example, to upper and lower magnitude thresholds LMT, UMT corresponding to that given electronically actuated valve 14 and source 6. It should be recognized that the lower magnitude threshold LMT and/or upper magnitude threshold UMT (as well as timing thresholds to be discussed below) stored as threshold data 72 vary depending on the consistency, temperature, and/or other characteristics of content from a given source 6, and the electronically actuated valve 14 corresponding thereto.

In certain embodiments, the system is configured to learn the specific characteristics of a given fluid, for example via machine learning or artificial intelligence, including changes to the valve observed over time (e.g., due to wear, etc.). In certain embodiments, the control system 124 uses a lattice sense offline machine learning FPGA, for example trained using TensorFlow developed by the Google Brain Team, along with the Lattice Diamond compiler by Lattice Semiconductor™. By incorporating offline machine learning, control system 124 may function without the need for network connectivity to a cloud 202 or other devices such that the threshold data 72 is independent. A library may be generated such that specific data is available across an entire catalog of beverage offerings such that analysis is automatically performed based on the specific content provided at the corresponding source 6 (such as stored data for cola, root beer, fruit punch, iced tea, water, and carbonated water, for example).

If it is determined in step 306 that the current 64 does not exceed the lower magnitude threshold LMT, the electronically actuated valve 14 is determined in step 308 to be in the deenergized phase 68 (see FIGS. 5A-5B) and the current 64 continues to be monitored. If instead the current 64 is determined in step 306 to exceed the lower magnitude threshold LMT, the electronically actuated valve 14 is determined in step 310 to be in the energized phase 66, and a timer 74 (FIG. 6) is started. The process then includes monitoring and detecting in step 312 whether the current 64 dips down below the upper magnitude threshold UMT, but remains above the lower magnitude threshold LMT. If it is determined in step 312 that the current 64 does not dip between the upper magnitude threshold UMT and lower magnitude threshold LMT, the timer 74 continues counting in step 314 and the monitoring of current 64 continues. If instead it is determined in step 312 that the current does dip below the upper magnitude threshold UMT but remains above the lower magnitude threshold LMT, the valve is determined in step 316 to remain in the energized phase 66, but the timer 74 is stopped and the system 1 determines a final elapsed time since the timer 74 was started in step 310. This identification of the current 64 dipping between the upper magnitude threshold UMT and the lower magnitude threshold LMT in step 312 indicates that the electronically actuated valve 14 has physically opened, whereby the final elapsed time calculated in step 316 indicates the time required for such opening.

As discussed above, in the configuration shown in FIGS. 2A-2B the time for the electronically actuated valve 14 to open is less in a normal state than in a sold-out state. Therefore, it is then determined in step 318 whether the final elapsed time calculated in step 316 exceeds a time threshold TT also stored within the threshold data 72, whereby the time threshold TT indicates a transition point between normal and sold-out states. In the example above, if the final elapsed time for the electronically actuated valve 14 to open is below the time threshold TT, this indicates a non-sold-out state for the source 6, whereas above the time threshold TT indicates a sold-out state. In the example shown in FIGS. 5A-5B, the time threshold TT may be 12 milliseconds, for example. If it is determined in step 218 that the elapsed time does not exceed the time threshold TT, it is determined in step 320 that the source 6 is not sold-out. In contrast, if the elapsed time in step 318 is determined to exceed the time threshold TT, step 322 provides for indicating that the source 6 is sold-out.

In certain embodiments, the detection system 100 itself may provide some kind of indication that the source 6 has been identified as being sold-out, such as a visual or auditory indicator coupled to the ancillary circuit board 50. In other embodiments, the detection system 100 instead provides a signal to the main controller 5 of the beverage dispenser 2 to instead trigger indicators already available in the base machine, such as alarms, lights, messages, or communication to the operator via wireless or other protocols. Particularly cases in which the ancillary circuit board communicates wirelessly, the presently disclosed system provides for seamless integration as a retrofittable option for existing systems, not requiring any additional wiring.

The detection system 100 shown in FIGS. 3A-3B can be configured to provide additional benefits building upon the functions described above, and/or to add further functionality to the electronically actuated valve 14 and beverage dispenser 2 more generally. For example, the control system 124 within the detection system 100 can be configured to determine an operational state of the solenoid 20 based on this electrical output from the detector 125. This determination is not only useful in detecting a magnetic field has been generated to open an electrically actuated valve 14 (thus inferring whether the electrically actuated valve 14 is in an opened versus closed operational state), but also to determine the durations of each state, along with other useful data for analysis. For example, the control system 124 or other components communicating therewith may then determine usage data for an electrically actuated valve 14 not otherwise enabled by the electrically actuated valve 14.

In certain embodiments, the presently disclosed detection system 100 provides "smart" functionality to enable such features as trending performance and predicting maintenance needs, for example by monitoring the magnitude of electrical outputs produced by the detector 125 over time compared to expected thresholds for solenoids 20 in good working order. In this manner, the presently disclosed systems and methods may be used to enable an otherwise known base beverage dispenser 2 to join an Internet of Things (IOT) network, for example via a cloud 202 (FIG. 6). Other data provided by the detection system 100 includes valve actuation time, open and closed states, and the overall functionality of the valve.

In certain embodiments, the detection system 100 is powered by a power source (not shown) that is external, such as from the electrically actuated valve 14 and/or the beverage dispenser depending upon convenience. This power source may also be provided by separate circuitry as an add-on device. However, the inventors have identified that the power necessary for operating the detection system 100, including the control system 124, may alternatively be extracted via induction from the coil 24 of the electrically actuated valve 14 itself, specifically via the magnetic field produced by the solenoid 20. This embodiment is particularly applicable in configurations in which the detector 125 is a coil 128 comprised of a wire 131 wrapped around a bobbin 132 (see FIG. 4B). Specifically, the coil 128 may be used not only to detect the magnetic field produced by the solenoid 20, but may also to harvest power therefrom. The inventors have further identified that this configuration is particularly advantageous in that the detection system 100 may be then truly wireless, not even requiring a separate power source for operation. This enables an operator to simply place the detection system 100 on the top 23 of the frame 22 containing the solenoid 20 for an electrically actuated valve 14 presently in the field, with no further connections required.

Under detection methods known in the art, any detection hardware is required to share power with the existing electrically actuated valve 14. Even in simple configurations, this sharing can lead to the introduction of noise into the electrically actuated valve 14, the detection system 100, or both. Likewise, these known systems and methods mandate finding space for routing the additional wiring in a beverage dispenser, where space is already at a premium. As described above, harvesting power wirelessly through the use of a coil 128 isolates the detection system 100 from the electrically actuated valve 14, providing better reliability for data transport. Similarly, since the detection system 100 has no moving parts or switches, reliability is further bolstered over other mechanisms for detecting the movement of the solenoid 20, and particularly the armature 27.

The present detection system 100 also simplifies the installation process and reduces the need for space. The ancillary circuit board 50 may simply be positioned atop the existing solenoid 20 with no fluid coupling, nor power or communication connections required. In addition, the presently disclosed systems and methods are operable with any brand, make, or model of electrically actuated valve 14, provided it operates through use of a magnetic field produced by the existing solenoid 20.

Figure 8:
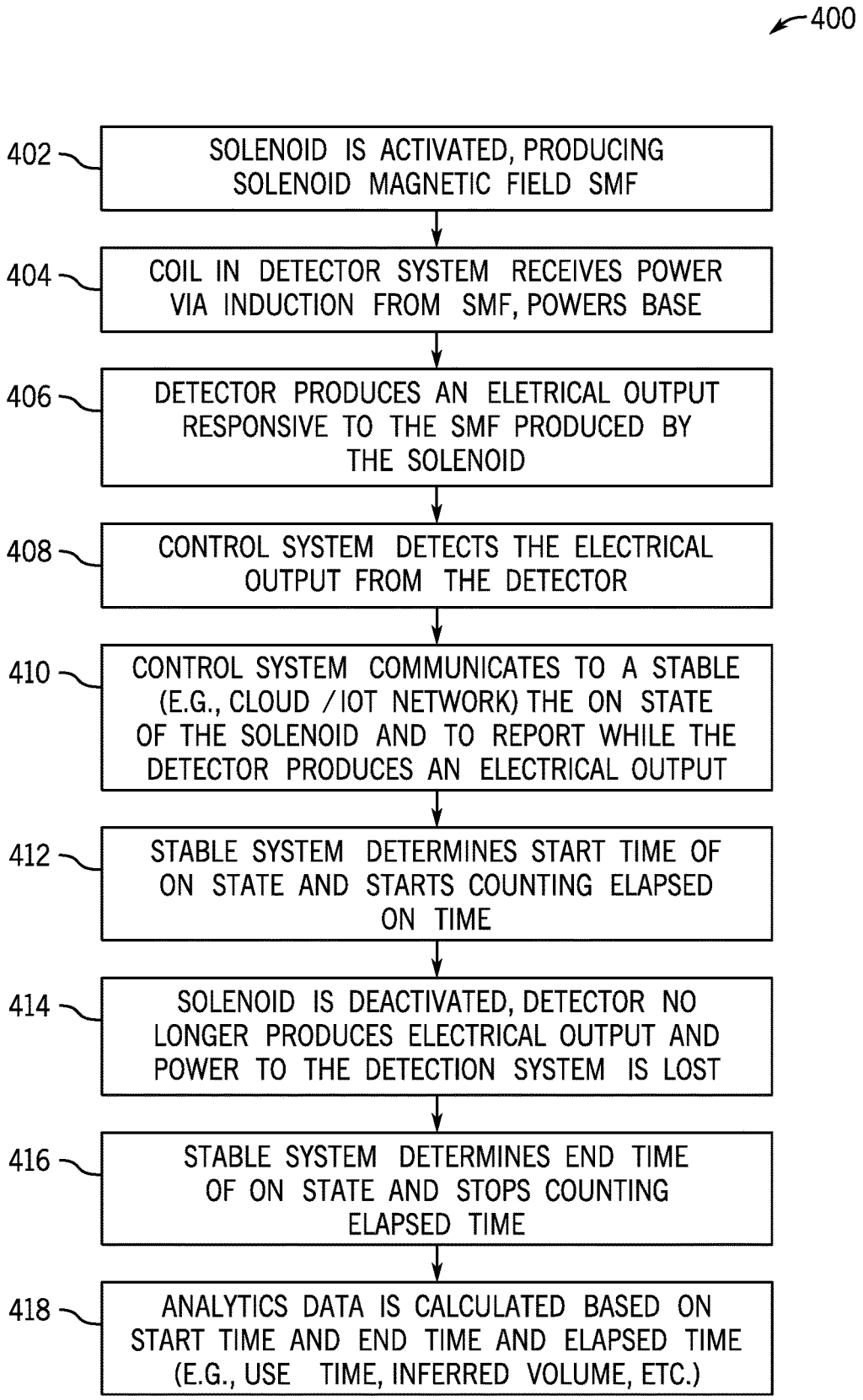
FIG. 8 depicts an exemplary process flow for detecting operation of a solenoid valve according to the present disclosure.

FIG. 8 depicts an exemplary method 400 for operating the detection system 100 responsive to events occurring within the beverage dispenser, and particularly the electrically actuated valve 14 therein. This example particularly shows a method 400 for operation using an embodiment of detection system 100 that is powered via induction from a coil 128, as discussed above. In step 402, the solenoid 20 is activated, thereby producing a magnetic field. The coil 128 within the detection system 100 receives power via induction from the magnetic field created by the solenoid 20, thereby powering the ancillary circuit board 50 and other components within the detection system 100, such as the control system 124 in step 404.

Next, the detector 125 (which may be the same as the coil 128, or may be a Hall Effect sensor 126, for example) produces an electrical output responsive to the SMF produced by the solenoid 20, which the control system 124 then detects, in steps 406 and 208, respectively. The control system 124 then communicates in step 410 to a stable system, such as a controller 5 contained within the beverage dispenser, and/or with a cloud 202 or IOT network to share the on state status of the solenoid 20. This communication may be wireless as discussed above, such as through Bluetooth®, Wi-Fi, and/or other protocols (e.g., such as may be used for access badges in a building security system). In other embodiments, such as those in which the detection system 100 is built into an electrically actuated valve 14, communication may occur by virtue of other wiring coupled between the beverage dispenser and the electrically actuated valve 14 for operation of the valve, for example.

This communication between the detection system 100 and the stable system continues such that detection system 100 reports this on state as long as the detector 125 continues to produce an electrical output. The stable system uses this information from the control system 124 to determine a start time for the on state of the solenoid 20, and also to start counting an elapsed on timer 74 in step 412. Once the solenoid is deactivated in step 414, the detector 125 no longer produces an electrical output and power to the detection system 100 is lost. The stable system then determines an end time of the on state for the solenoid 20, and stops counting the elapsed time in step 416. This information may then be taken in step 418 for developing analytics data based on the start time, end time, and elapsed time for the on state of the solenoid 20. This analytics data may be used to determine usage times, inferred volumes based on the knowledge of on state times and flow rates for a particular electrically actuated valve 14, and/or other information relating to operation of the electrically actuated valve 14 and when the solenoid 20 therein is in the on state versus the off state.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A detection device for detecting that a source is sold-out for a beverage dispenser, the beverage dispenser dispensing from the source via a valve controlled by a solenoid, the detection device comprising:
   - a circuit board configured to be positioned on the valve proximal to the solenoid;
   - a detector coupled to the circuit board, wherein the solenoid creates a magnetic field when dispensing from the valve, and wherein the detector is configured to detect the magnetic field created by the solenoid and to produce an electrical output when the magnetic field is detected; and
   - a control system coupled to the circuit board in communication with the detector, wherein the control system is configured to access threshold data, wherein the control system is configured to compare the electrical output of the detector to the threshold data, and wherein the control system indicates that the source is sold-out based upon the comparison of the electrical output to the threshold data.

2. The detection device according to claim 1, wherein the solenoid axially translates an armature when the magnetic field is generated, and wherein the circuit board defines an opening configured to allow the armature to be axially translated therethrough.

3. The detection device according to claim 1, wherein the solenoid is contained within a frame and axially translates an armature out a top of the frame when the magnetic field is generated, and wherein the circuit board is configured to be positioned on the top of the frame opposite the solenoid.

4. The detection device according to claim 1, wherein the threshold data includes both a magnitude threshold and a time threshold, wherein the magnitude threshold is a magnitude of the electrical output of the detector, and wherein the time threshold corresponds to an elapsed time between crossings of the magnitude value by the electrical output of the detector.

5. The detection device according to claim 4, wherein the magnitude threshold includes a lower magnitude threshold and an upper magnitude threshold, wherein a first time crossing occurs when the electrical output of the detector first exceeds the lower magnitude threshold, wherein a second time crossing occurs when the electrical output of the detector first decreases below the upper magnitude threshold after the first time crossing, and wherein the elapsed time is the difference between the second time crossing and the first time crossing.

6. The detection device according to claim 5, wherein the time threshold for the source is 12 ms, and wherein the control system indicates that the source is sold-out when the elapsed time is determined to be greater than the time threshold.

7. The detection device according to claim 1, wherein the source is nitrogen gas.

8. The detection device according to claim 1, wherein the solenoid has a coil that creates the magnetic field, and wherein the detector is axially aligned with the coil.

9. The detection device according to claim 1, wherein the detector is a Hall Effect sensor.

10. The detection device according to claim 1, wherein the detector is a coil, and wherein the coil harvests induction energy from the magnetic field to provide power for the detection device.

11. The detection device according to claim 10, wherein the detector is electrically isolated from the valve.

12. The detection device according to claim 1, wherein the detection device is configured to communicate wirelessly with a stable system displaced from the detection device.

13. The detection device according to claim 12, wherein the detection device wirelessly communicates operating time information for the solenoid to the stable system.

14. A method for detecting that a source is sold-out for a beverage dispenser, the beverage dispenser dispensing from the source via a valve controlled by a solenoid, the method comprising:

coupling a detector to a circuit board, wherein the solenoid creates a magnetic field when dispensing from the valve, and wherein the detector is configured to detect the magnetic field created by the solenoid and to produce an electrical output when the magnetic field is detected;

providing threshold data accessible relating to the electrical output of the detector when detecting the magnetic field from the solenoid;

coupling the control system to the circuit board in communication with the detector, wherein the control system is configured to access the threshold data, and wherein the control system is configured to compare the electrical output of the detector to the threshold data; and positioning the circuit board on the valve proximal to the solenoid, wherein the control system indicates whether the source is sold-out based upon the comparison of the electrical output to the threshold data.

15. The method according to claim 14, wherein the threshold data includes both a magnitude threshold and a time threshold, wherein the magnitude threshold is a magnitude of the electrical output of the detector, and wherein the time threshold corresponds to an elapsed time between crossings of the magnitude value by the electrical output of the detector.

16. The method according to claim 15, wherein the magnitude threshold includes a lower magnitude threshold and an upper magnitude threshold, wherein a first time crossing occurs when the electrical output of the detector first exceeds the lower magnitude threshold, wherein a second time crossing occurs when the electrical output of the detector first decreases below the upper magnitude threshold after the first time crossing, and wherein the elapsed time is the difference between the second time crossing and the first time crossing.

17. The method according to claim 15, wherein the control system indicates that the source is sold-out when the elapsed time is determined to be greater than the time threshold.

18. The method according to claim 14, wherein the detector is a coil, and wherein the coil harvests induction energy from the magnetic field to provide power for the detection device.

19. The method according to claim 14, further comprising configuring the control system to communicate wirelessly with a stable system regarding operation of the solenoid.

20. A detection device for detecting that a source is sold-out for a beverage dispenser, the beverage dispenser dispensing from the source via a valve controlled by a solenoid that axially translates an armature through a top of a frame containing the solenoid, the detection device comprising:

a circuit board configured to be positioned on top of the valve proximal to the solenoid, wherein the circuit board is electrically and fluidly isolated from the solenoid, and wherein an opening is defined in the circuit board such that the armature extends therethrough;

a detector coupled to the circuit board, wherein the solenoid creates a magnetic field when dispensing from the valve, and wherein the detector is configured to detect the magnetic field created by the solenoid and to produce an electrical output when the magnetic field is detected; and a control system coupled to the circuit board in communication with the detector, wherein the control system is configured to access threshold data, wherein the threshold data includes both a magnitude threshold and a time threshold, wherein the magnitude threshold includes a lower magnitude threshold and an upper magnitude threshold, wherein a first time crossing occurs when the electrical output of the detector first exceeds the lower magnitude threshold, wherein a second time crossing occurs when the electrical output of the detector first decreases below the upper magnitude threshold after the first time crossing, and wherein the time threshold corresponds to an elapsed time between the electrical output of the detector crossing the magnitude value, and wherein the control system is configured to compare the electrical output of the detector to the threshold data;

wherein the control system indicates that the source is sold-out based upon the comparison of the electrical output to the threshold data.

* * * * *